US006245447B1

(12) United States Patent
Nazmy et al.

(10) Patent No.: US 6,245,447 B1
(45) Date of Patent: Jun. 12, 2001

(54) IRON ALUMINIDE COATING AND METHOD OF APPLYING AN IRON ALUMINIDE COATING

(75) Inventors: Mohamed Nazmy, Fislisbach; Markus Staubli, Dottikon, both of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/201,780

(22) Filed: Dec. 1, 1998

(30) Foreign Application Priority Data

Dec. 5, 1997 (DE) ..... 197 53 876

(51) Int. Cl.[7] ..... C23C 30/00; C23C 38/06; C23C 38/18; C23C 38/22

(52) U.S. Cl. ..... 428/633; 428/678; 428/679; 428/670; 428/681; 416/241 R; 416/241 B

(58) Field of Search ..... 428/633, 678, 428/679, 670, 681; 416/241 R, 241 B

(56) References Cited

U.S. PATENT DOCUMENTS

| | | | |
|---|---|---|---|
| 4,004,047 | * | 1/1977 | Grisik . |
| 4,144,380 | * | 3/1979 | Beltran et al. . |
| 4,321,311 | * | 3/1982 | Strangman . |
| 4,348,433 | | 9/1982 | Kammer et al. . |
| 4,429,019 | * | 1/1984 | Schrewelius . |
| 4,447,503 | | 5/1984 | Dardi et al. . |
| 4,535,034 | * | 8/1985 | Zaizen et al. . |
| 4,789,441 | | 12/1988 | Foster et al. . |
| 4,880,614 | * | 11/1989 | Strangman . |
| 4,969,960 | * | 11/1990 | Lehnert et al. . |
| 5,411,702 | * | 5/1995 | Nazmy et al. . |
| 5,422,070 | * | 6/1995 | Nazmy et al. . |
| 5,512,382 | * | 4/1996 | Strangman . |
| 5,562,998 | * | 10/1996 | Strangman . |
| 5,667,663 | * | 9/1997 | Rickerby et al. . |

FOREIGN PATENT DOCUMENTS

| | | |
|---|---|---|
| 959681 | 3/1957 | (DE) . |
| 1 258 110 | 1/1968 | (DE) . |
| 1946237 | 3/1971 | (DE) . |
| 2922737C2 | 12/1980 | (DE) . |
| 3010608 | 12/1980 | (DE) . |
| 3822874A1 | 1/1989 | (DE) . |
| 3821896A1 | 12/1989 | (DE) . |
| 4229600C1 | 11/1993 | (DE) . |
| 0 061 322 | 9/1982 | (EP) . |
| 0625585B1 | 5/1997 | (EP) . |
| 822 317 | 12/1937 | (FR) . |
| 3804359C1 | 11/1988 | (GB) . |
| 5- 320701 | 12/1993 | (JP) . |
| WO8503465 | 8/1985 | (WO) . |

* cited by examiner

*Primary Examiner*—Deborah Jones
*Assistant Examiner*—Jason Savage
(74) *Attorney, Agent, or Firm*—Burns, Doane, Swecker & Mathis, L.L.P.

(57) ABSTRACT

An iron aluminide coating as a bonding layer between a thermally stressed element of a thermal turbomachine and a heat insulation coat consists essentially of:

| | | |
|---|---|---|
| 5–35 | % by weight | aluminum |
| 15–25 | % by weight | chromium |
| 0.5–10 | % by weight | molybdenum, tungsten, tantalum and/or niobium |
| 0–0.3 | % by weight | zirconium |
| 0–1 | % by weight | boron |
| 0–1 | % by weight | yttrium |

the remainder being iron and incidental impurities arising from production thereof.

6 Claims, 2 Drawing Sheets

IRON ALUMINIDE COATING AND METHOD OF APPLYING AN IRON ALUMINIDE COATING

BACKGROUND OF THE INVENTION

Field of the Invention

The invention proceeds from an iron aluminide coating and a method of applying an iron aluminide coating to a substrate.

BACKGROUND

EP 0 625 585 B1 has disclosed a Fe—Cr—Al alloy possessing high oxidation resistance. Said alloy has been used to produce foils for catalyst supports in catalytic converters.

Coatings produced from this alloy, however, especially at high temperatures and as a coating of thermally stressed elements of thermal turbomachines, exhibited inadequate oxidation properties.

In order to apply heat insulation coats to blades, heat shields, etc. of thermal turbomachines and combustion chambers, it is common to apply to these elements a bonding layer by the vacuum plasma technique. Disadvantages of these bonding layers are that the bonding layer commonly fails at service temperatures above 900° C., and the heat insulation coat falls off, and also the inadequate oxidation resistance of the bonding layer.

SUMMARY OF THE INVENTION

Accordingly, one object of the invention is to improve the oxidation behavior of an iron aluminide coating of the type referred to at the outset.

This object is achieved in accordance with the invention by providing an iron aluminide coating having the following composition:

| | | |
|---|---|---|
| 5–35 | % by weight | aluminum |
| 15–25 | % by weight | chromium |
| 0.5–10 | % by weight | molybdenum, tungsten, tantalum and/or niobium |
| 0–0.3 | % by weight | zirconium |
| 0–1 | % by weight | boron |
| 0–1 | % by weight | yttrium |

the remainder being iron and also impurities and additaments arising from its production.

One of the advantages of the invention is that the coating has good oxidation resistance, especially at temperatures above 1000° C. The use of intermetallic phases, moreover, has the advantage that the coating does not fail even at high temperatures; this is a particular advantage if the coating is used as a bonding layer for a heat insulation coat. The iron aluminide coating is therefore of outstanding suitability as a coating and bonding layer for thermally stressed elements of thermal turbomachines.

The ductile brittle transition temperature (DBTT) of the coatings of the invention is situated lower than that of conventional nickel-based coatings, which is highly advantageous for their use as coatings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show measurement examples and wherein.

Figure 1:
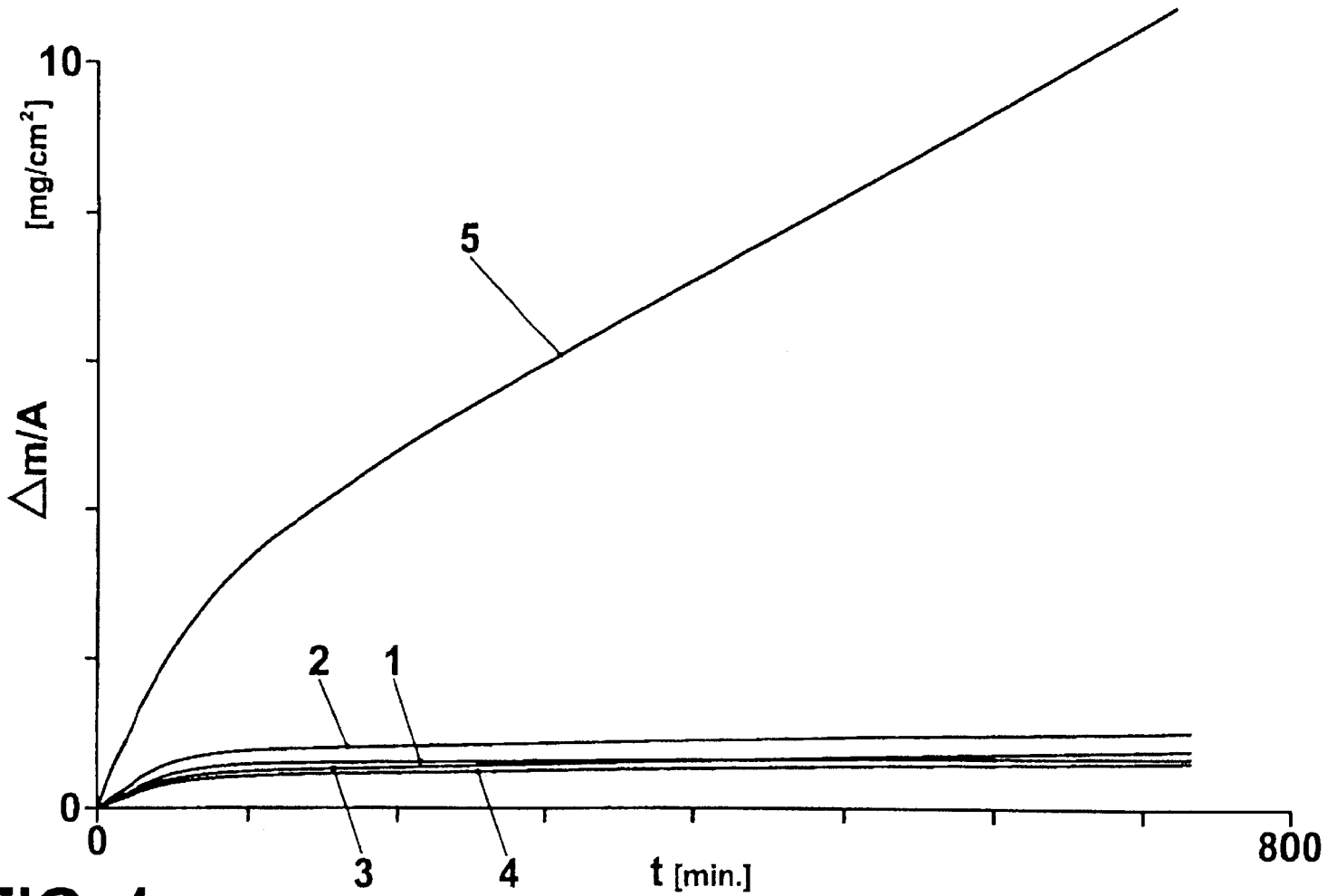
FIG. 1 shows weight change in relation to surface area [Δm/A] at 1050° C. versus time in minutes.

The elements shown are only those essential for an understanding of the invention.

DESCRIPTION OF THE PREFERRED EMBODIMENTS

Coatings on the basis of intermetallic phases based on iron aluminides have been developed. A preferred range is:

| | | |
|---|---|---|
| 5–35 | % by weight | aluminum |
| 15–25 | % by weight | chromium |
| 0.5–10 | % by weight | molybdenum, tungsten, tantalum and/or niobium |
| 0–0.3 | % by weight | zirconium |
| 0–1 | % by weight | boron |
| 0–1 | % by weight | yttrium |

the remainder being iron and also impurities and additaments arising from its production.

A particularly preferred range is:

| | | |
|---|---|---|
| 10–25 | % by weight | aluminum |
| 15–20 | % by weight | chromium |
| 2–10 | % by weight | molybdenum, tungsten, tantalum and/or niobium |
| 0.1–0.3 | % by weight | zirconium |
| 0.1–0.5 | % by weight | boron |
| 0.2–0.5 | % by weight | yttrium |

the remainder being iron and also impurities and additaments arising from its production.

The inventive combination of the above-described elements produces an intermetallic phase having outstanding oxidation properties and high thermal stability.

The coatings can be applied by means of CVD, PVD, plasma spraying, etc., to the thermally stressed elements of thermal turbomachines.

Aluminum is absolutely necessary in order to achieve outstanding oxidation resistance. If the aluminum content falls below 5% by weight the oxidation resistance becomes inadequate, while at an aluminum content above 35% by weight the material becomes brittle. The aluminum content is therefore from 5 to 35% by weight, preferably from 10 to 25% by weight.

Chromium increases the oxidation resistance and enhances the effect thereon of aluminum. If the chromium content falls below 15% by weight the oxidation resistance becomes inadequate, while at a chromium content above 25% by weight the material becomes too brittle. The chromium content is therefore from 15 to 25% by weight, preferably from 15 to 20% by weight.

Molybdenum, tungsten, tantalum and niobium likewise increase the oxidation resistance and also improve the morphology of the oxide layer and reduce the interdiffusion between the coating and the substrate material. The overall content of these elements should not fall below 0.5% by weight nor exceed a level of 10% by weight. The overall content of molybdenum, tungsten, tantalum and niobium is therefore from 0.5 to 10% by weight, preferably from 2 to 10% by weight.

Zirconium increases the oxidation resistance and the ductility of the material but its content should not exceed 0.3% by weight. The zirconium content is therefore not more than 0.3% by weight, preferably from 0.1 to 0.3% by weight.

Boron likewise increases the ductility of the material but its content should not exceed 1% by weight. The boron content is therefore not more than 1% by weight, preferably from 0.1 to 0.5% by weight.

Yttrium forms $Y_2O_3$ and increases the adhesion of the coating to the substrate material, but its content should not exceed 1% by weight. The yttrium content is therefore not more than 1% by weight, preferably from 0.2 to 0.5% by weight.

WORKING EXAMPLE 1

TABLE 1

| Alloy in % by wt. | Fe | Cr | Al | Ta | Mo | B | Zr | Y |
|---|---|---|---|---|---|---|---|---|
| 1 | remainder | 20 | 10 | 4 | — | 0.05 | 0.2 | 0.2 |
| 2 | remainder | 17 | 20 | 4 | — | 0.05 | 0.2 | 0.5 |
| 3 | remainder | 20 | 15 | — | 4 | 0.05 | 0.2 | 0.5 |
| 4 | remainder | 20 | 6 | 4 | — | 0.05 | 0.2 | 0.5 |
| 5 | remainder | 25 | 5 | — | 4 | 0.05 | 0.2 | 0.5 |

Button-sized samples of about 2 mg were produced from the alloys 1 to 5 of Table 1 by arc melting. The samples were remelted three times in order to ensure sufficient homogeneity. They were then forged isothermally at 900° C. at a crosshead speed of 0.1 mm/s. The deformation factor during forging was 1.28. Thereafter, the samples were heat-treated; that is, they were held at 1000° C. for one hour and then cooled in the oven. The surface of the samples was then sandblasted. The final size of the samples was about 40 mm in diameter with a thickness of from 2 to 2.5 mm.

These samples were then held in air at 1050° C. and the weight change was measured in proportion to the surface area.

According to FIG. 1, the samples of alloys 1, 3 and 4 show outstanding oxidation behavior. After just a few minutes the samples no longer exhibit any weight increase, and the weight increase relative to the surface area [Δm/A] is below 1 mg/cm$^2$.

The sample of alloy 2 also shows outstanding oxidation behavior but is slightly poorer than the samples of alloys 1, 3 and 4. Nevertheless, even after a few minutes sample 2 exhibits no further weight increase, and the weight increase in relation to the surface area [Δm/A] is still below 1 mg/cm$^2$.

The sample of alloy 5, which corresponds in its Cr and Al content to EP 0 625 585 B1, shows a much poorer oxidation behavior. Although the weight increase in relation to the surface area [Δm/A] no longer increases so greatly after a few minutes, a steady weight increase was still measured over the entire period of measurement.

WORKING EXAMPLE 2

TABLE 2

| Alloy in % by wt. | Fe | Cr | Al | Ta | Mo | B | Zr | Y |
|---|---|---|---|---|---|---|---|---|
| 6 | remainder | 20 | 15 | — | 4 | 0.05 | 0.2 | — |
| 7 | remainder | 15 | 15 | — | 4 | 0.05 | 0.2 | 0.2 |

Figure 2:
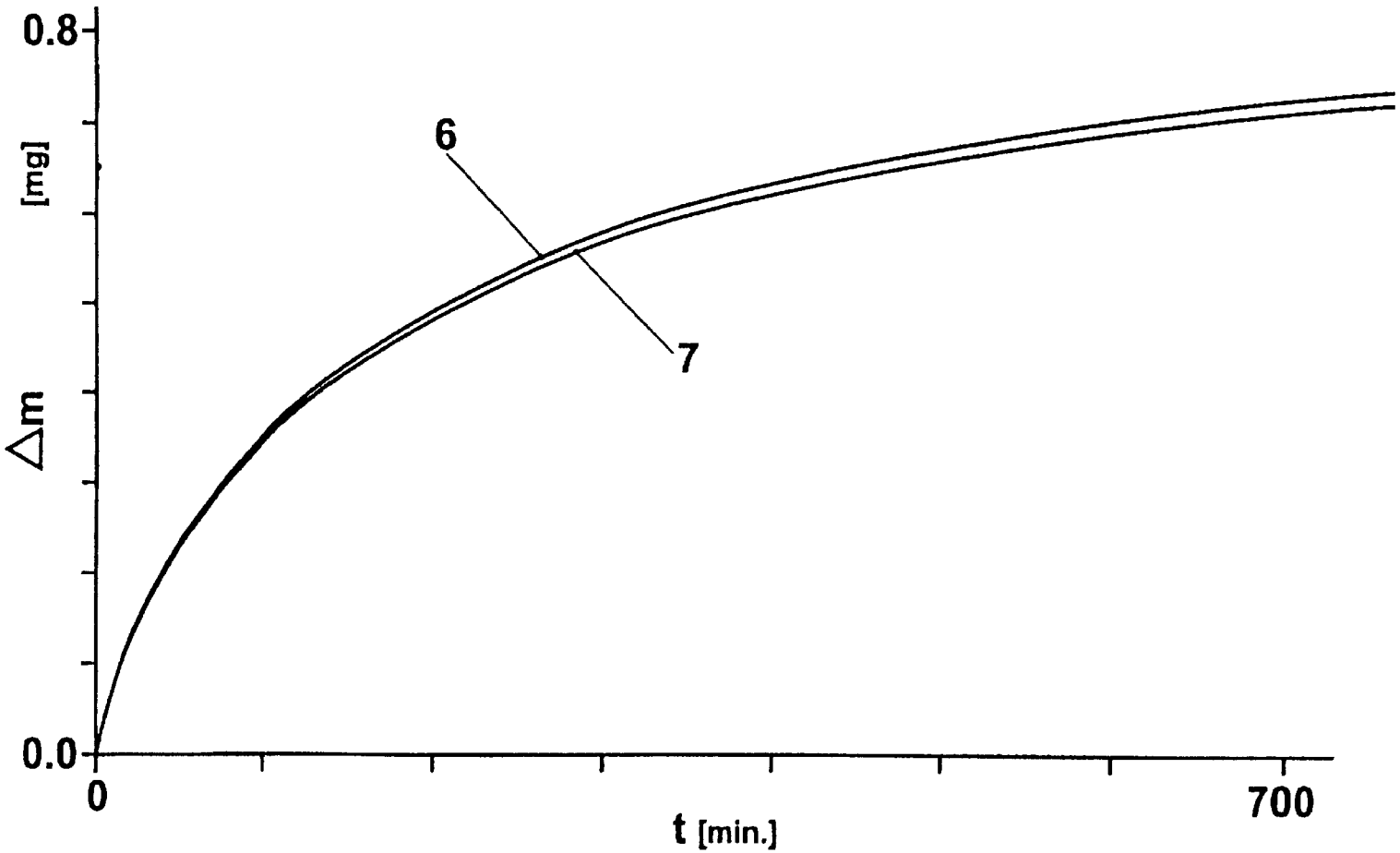
FIG. 2 shows weight change [Δm] at 1300° C. versus time in minutes.

Samples were produced from the alloys 6 and 7 of Table 2, and the oxidation behavior was investigated in air at 1300° C. In accordance with FIG. 2, the samples show outstanding oxidation behavior at 1300° C. and after approximately 10 hours likewise exhibited virtually no further weight increase through oxidation.

The iron aluminide coating can be applied directly to workpieces, especially thermally stressed elements of thermal turbomachines, examples being blades, heat shields, linings of combustion chambers, etc., made of nickel-based alloys. It is advantageous to dispose a layer of platinum between the iron aluminide coating and the nickel-based alloy. This platinum layer functions as a diffusion barrier between the iron aluminide coating and the nickel-based alloy. The platinum layer preferably has a thickness of from 10 to 20 μm.

The iron aluminide coating can be used as a bonding layer between thermally stressed elements of thermal turbomachines, examples being blades, heat shields, linings of combustion chambers, etc., and a heat insulation coat. The heat insulation coat in this case consists, for example, of zirconium oxide which has been partly or fully stabilized with yttrium oxide, calcium oxide or magnesium oxide.

Obviously, numerous modifications and variations of the present invention are, possible in light of the above teachings. It is therefore to be understood that, within the scope of the appended claims, the invention may be practiced otherwise than as specifically described herein.

What is claimed is:

1. An iron aluminide coating on a substrate consisting essentially of:

| | | |
|---|---|---|
| 10–25 | % by weight | aluminum |
| 15–20 | % by weight | chromium |
| 2–10 | % by weight | molybdenum, tungsten, tantalum and/or niobium |
| 0.1–0.3 | % by weight | zirconium |
| 0.1–0.5 | % by weight | boron |
| 0.2–0.5 | % by weight | yttrium |

the remainder being iron and incidental impurities arising from production thereof.

2. The iron aluminide coating as claimed in claim 1 as a bonding layer between a thermally stressed element of a thermal turbomachine and a heat insulation coat.

3. The iron aluminide coating as claimed in claim 2, wherein the thermally stressed element consists of a nickel-based alloy.

4. The iron aluminide coating as claimed claim 2, wherein a platinum layer is disposed between the thermally stressed element and the iron aluminide coating.

5. The iron aluminide coating as claimed in claim 4, wherein the platinum layer has a thickness of 10 to 20 μm.

6. The iron aluminide coating as claimed in claim 2, wherein the thermally stressed element comprises a blade, heat shield or lining of a combustion chamber.

* * * * *